United States Patent [19]

Wiedemann

[11] Patent Number: 5,031,241

[45] Date of Patent: Jul. 16, 1991

[54] FASHION PRESERVING BIB

[76] Inventor: Martin F. Wiedemann, P.O. Box 677, Muscatine, Iowa 52761

[21] Appl. No.: 585,303

[22] Filed: Sep. 19, 1990

[51] Int. Cl.[5] ..... A41D 27/12

[52] U.S. Cl. ..... 2/49 R; 2/46

[58] Field of Search ..... 2/46, 48, 49 R, 50, 2/51, 52, 115, 119, 120, 145

[56] References Cited

U.S. PATENT DOCUMENTS

| | | | |
|---|---|---|---|
| 155,752 | 10/1949 | Vivaudou . | |
| 197,115 | 12/1963 | Clayfield . | |
| 232,276 | 8/1874 | Andersson et al. . | |
| 297,583 | 9/1888 | Hall . | |
| 2,423,581 | 7/1947 | Clark | 2/46 X |
| 2,633,440 | 3/1953 | Scholl | 2/49 R |
| 2,747,192 | 5/1956 | Katz | 2/46 |
| 2,949,611 | 8/1960 | Wilkaitis . | |
| 3,010,111 | 11/1961 | Ralph | 2/49 R |
| 3,230,547 | 1/1966 | Moran, Jr. | 2/49 R |
| 3,416,157 | 12/1968 | Marder et al. | 2/49 R |
| 3,488,773 | 1/1970 | Stemmer . | |
| 3,540,060 | 11/1970 | Brown | 2/49 R |
| 3,714,669 | 2/1973 | Vorbau | 2/46 |
| 3,833,937 | 9/1974 | Taylor | 2/46 |
| 3,989,776 | 9/1976 | Gruenwald . | |
| 4,288,877 | 9/1981 | Klepfer | 2/48 |
| 4,306,316 | 12/1981 | Klepfer | 2/48 |
| 4,330,888 | 5/1982 | Klepfer . | |
| 4,423,523 | 1/1984 | Bodner et al. | 2/49 R |
| 4,710,979 | 12/1987 | Bull et al. . | |
| 4,843,644 | 7/1989 | Sugarman . | |

*Primary Examiner*—Werner H. Schroeder
*Assistant Examiner*—Jeanette E. Chapman
*Attorney, Agent, or Firm*—Simmons, Perrine, Albright & Ellwood

[57] ABSTRACT

A fashion preserving bib is disclosed which is formed of a substantially transparent plastic sheet of material. The bib has a pocket along the lower edge with an upwardly open edge adjacent the outer surface of the sheet, such that the pocket would be positioned to catch food drippings when the bib is attached by adhesive regions at each upper corner of an inner surface of the sheet to a frontal region of a garment of a person. The pocket along the lower edge of the bib is spaced open by means of one or more spacers, such that an outer flap of the pocket does not close when the bib conforms to the curvature of the body of its wearer. A respective spacer is preferably of a polyurethane material, and at least one spacer is attached centered on the lateral length of the flap adjacent an upper edge thereof. An absorbent material is disposed in the pocket along its bottom and across the width of the bib, such that liquids running into the pocket may be absorbed thereby and retained within the pocket.

3 Claims, 1 Drawing Sheet

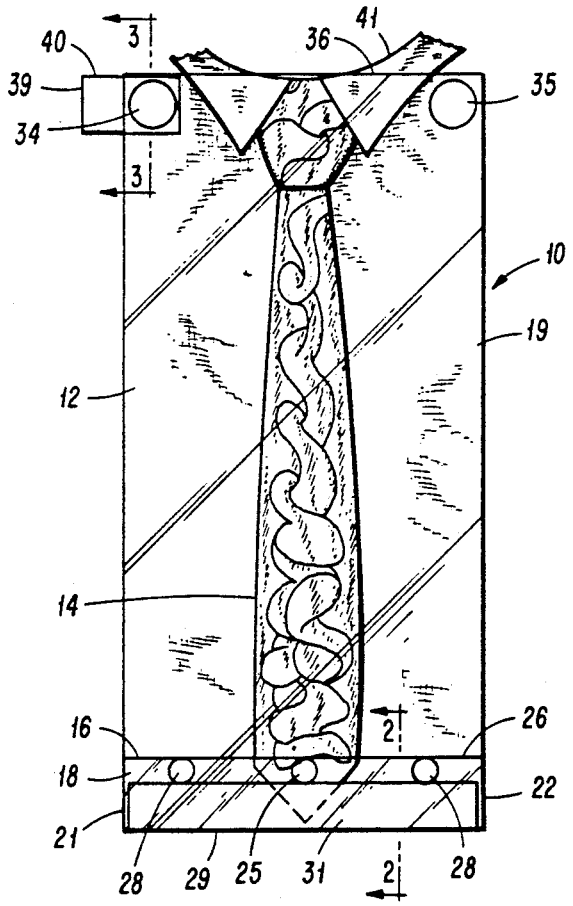
FIG. 1
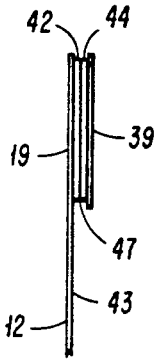
FIG. 3
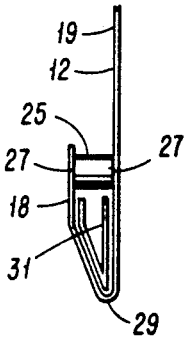
FIG. 2
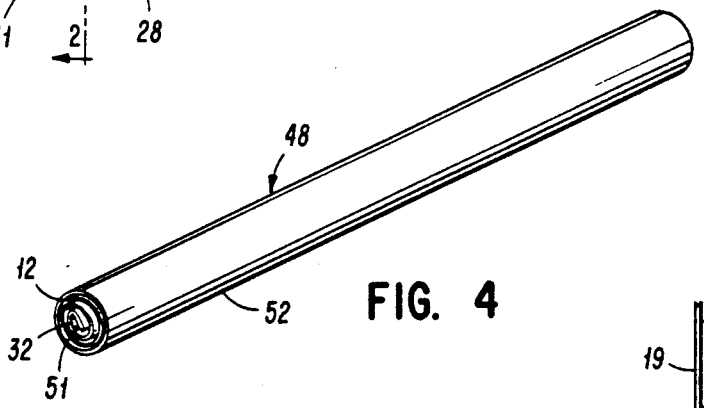
FIG. 4
FIG. 5
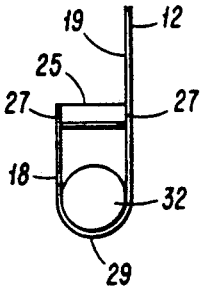
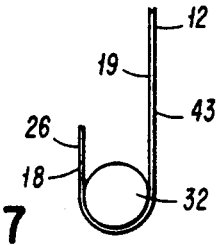
FIG. 7
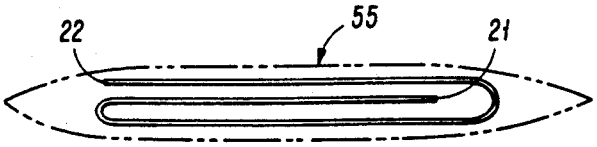
FIG. 6

FASHION PRESERVING BIB

BACKGROUND OF THE INVENTION

1. Field of the Invention

The invention relates generally bibs and more particularly to bibs to be worn by adults.

2. Discussion of the Prior Art

Various types of bibs or similar protective articles are known which may or are even intended to be worn by adults. U.S. Design Pat. No. DES. 279,583 shows a bib with the design of a tie, for example. Another example is a dental towel disclosed in U.S. Pat. No. 3,488,773. A plastic backing sheet is covered toward an outer surface with absorbent paper sheets. Pressure sensitive material is disposed on the back side of the of the plastic material on three corners of the towel. A protective strip of material covers the adhesive material prior to use.

Other bibs are for use be people who may not have total control of their motions, and, yet, it may be important that they feed themselves, such as the aged or those confined to hospitals. U.S. Pat. No. 4,306,316 provides a bib-type garment which has a coating or pressure sensitive adhesive along an upper edge thereof. The adhesive is protected until use by folding the material with the pressure sensitive material being folded onto itself. For use, the folded bib is opened allowing the adhesive layer to be placed against a person's clothing or body.

The art of bibs has produced over the years many improvements which allow bibs in general to become adapted most ideally to many specific situations. However, lifestyles change over a period of years and further improvements are needed to adapt the general usefulness optimally to specific needs. Ties have been worn by men as essential parts of business or formal attire. The exposure of ties and the risk of ruin of a tie of quality is only exceeded by the cost of having it cleaned after it has become soiled.

The need for protecting a tie from becoming soiled has been recognized, for example, in U.S. Pat. No. 4,843,644. A bib is stowed within the front and rear ply of the tie. A zipper closes the rear slot for stowing the bib, such that the bib may be removed when needed. While this is one solution for having available a bib for protecting a tie, most ties do not carry bibs for ready use. Also, a risk of having food spill beyond a lower edge of the bib is not addressed by the above-mentioned patent.

Food soiling clothing below the lower edge of a protective garment is, however, a problem known to exist, particularly when a bib is of a liquid-impervious material, such as a plastic material. When food, often being liquid-based as, for example soup, is spilled, it is likely to run past down the bib and onto clothing below the lower edge of the bib. A bib is known which provides a folded lower edge to form a pocket. Such pocket might seem to solve the problem. However, it has been found that such pocket has a tendency to close, particularly when the bib follows the convex curvature of the wearer's body. Food spillage then still tends to drop beyond a lower edge of the bib and does its damage on clothing. This is particularly annoying in airline seats, where a passenger may need to remain seated until the food tray has been removed and the spilled food is not readily found in creases of clothing.

SUMMARY OF THE INVENTION

It is an object of the invention to provide a bib which may be made readily available as an individually packaged item for protecting a decorative frontal garment of a person and in particular for protecting such frontal garment in a manner in which the intended use of the garment to adorn its wearer is not eliminated by the presence of the protection.

It is a further object of the invention to provide a fashion preserving protective garment which may be readily available to business travelers who may need to eat when seated where little space is available, such as in airplanes, for example.

It is another object of the invention to provide a bib which is impervious to liquids and which provides an improved means for preventing liquids from spilling past the lower edge of a bib.

It is yet another object of the invention to provide a throw away protective bib which is inexpensive and need not be re-used.

In accordance with the present invention a bib is provided which comprises a substantially transparent plastic sheet of rectangular shape and respective inner and outer major surfaces, shorter edges of the rectangular shape of the sheet defining respectively upper and lower edges of the bib. Adhesive regions are disposed on the inner surface adjacent upper corners of the bib, the regions having an outer surface of low adhesive strength allowing the bib to become attached temporarily to the clothing of the wearer. A lower edge of the bib has an upward folded lower material portion, folded toward and onto the outer surface of the sheet and attached adjacent lateral edges of the sheet, forming an upward open pocket on the outer surface of the bib. The pocket is lined with absorbent material and is spaced open by at least one absorbent spacer of a thickness to space the folded material from the sheet forming the bib.

In a particular embodiment of the invention the adhesive regions may be covered by a protective tab of material which is of a size larger than the adhesive region and which extends laterally or vertically beyond the edge of the major surface of the bib such that the extending length may be gripped for convenient removal of the tab.

According to an aspect of the invention, the bib is rolled into an elongate, cylindrical package, the package being suitable to package with typical eating utensils provided in plastic wraps with meals on airlines and with similarly prepared food offerings.

BRIEF DESCRIPTION OF THE DRAWINGS

The description of a particular embodiment of the invention may be best understood when read in reference to the appended drawings wherein:

FIG. 1 shows a frontal view of a fashion preserving bib;

FIG. 2 is a partial, sectional view taken along the line "2—2" and showing a lower pocket of the bib in greater detail;

FIG. 3 is a partial, sectional view of the bib taken along the line "3—3", highlighting details in exaggerated scale of an adhesive patch in an upper corner of the bib;

FIG. 4 is a pictorial representation of one type of package for the bib of the present invention;

FIG. 5 shows a partial, sectional view of an alternate embodiment of the bib taken along line "3—3", the illustrated embodiment being adapted for packaging as shown in FIG. 4;

FIG. 6 is a schematic end view of the bib of FIG. 1, showing yet another manner of packaging; and FIG. 7 shows a variation of the alternate embodiment of the bib shown in FIG. 5, wherein a spacer and absorbent material are combined in function.

DETAILED DESCRIPTION OF THE INVENTION

In FIG. 1 there is shown a bib, designated generally by the numeral 10, which is particularly intended to be worn by well dressed adult persons while they are eating, particularly in public. The bib is preferably of a thin, substantially transparent plastic material. As an example, a two mil (0.002 inch) thick polyethylene plastic sheet material is considered to be satisfactory. In that the bib is desirably herewith expendable, the material may be of a bio-degradable plastic. Of course, a range of material thicknesses from approximately ½ mil to even 15 mil may be considered suitable for the need. A two-mil thick polyethylene sheet 12 is flexible and essentially clear, projecting at most a slightly hazy appearance. Particularly when an object is placed directly adjacent the surface of the plastic surface, the object remains clearly visible through the material. Substantial transparency is significant in that it is sought to protect a person's tie 14 from becoming soiled while the person is eating, and the protection is to be available without noticeable loss of the aesthetic impression afforded by the tie. A person may risk soiling a particularly well designed tie rather than hide it from view. The bib 10 as further described herein will protect the tie 14 without hiding it from view. For example, from a table adjacent the one at which the person wearing the bib 10 is sitting, the bib most likely may remain unnoticed to a casual observer, the hazy appearance actually contributing to its disappearance like etched glass may not be seen because of the lack of reflection from its surface.

The size of the bib 10 may vary from other known sizes of bibs. It appears that to protect a person's tie 14, as shown in FIG. 1, it is desirable to provide a protective shield having a length of approximately eighteen inches. A width of nine inches is a preferred width for the bib 10, in that spilled food will in most instances be caught on a sheet of such width. It appears that a lesser width may be acceptable, in that spills will impact within a vertical band of about six inches from the center of a person. A lowermost portion of the tie 14 may be hidden from view by a lower pocket 16 of the bib 10. However, the lower portion of the tie 14 is typically hidden below a table's edge or food tray (not shown), such that the less sightly pocket 16 is also hidden from view.

A problem with prior art pockets for catching spilled food or liquids is overcome as further explained in reference to FIGS. 1 and 2. The preferred thickness of the sheet 12 is desirably flexible remain in spread contact with the clothing of the wearer. The pocket 16 is formed by folding a lower end or flap 18 of the sheet 12 over onto an outer surface 19 of the sheet 12. The flap 18 has a preferred length of one to two inches. The flap 18 may then preferably be bonded to lateral edges 21 and 22 of the sheet 12 in a conventional manner, such as by heat sealing or by applying a bonding material. The resulting pocket 16 without anything further, as is the case in known prior art pockets, has the tendency to remain closed when worn, in that the flap 18 tends to remain in contact with the sheet 12 of the bib 10. When food falls or drips down the length of such a bib, it falls or runs past such closed pocket onto the clothing of the person wearing the bib.

In the described embodiment, the problem is overcome by at least one spacer 25 which is preferably centrally symmetrically attached between the sheet 12 and the flap 18 adjacent an upper edge 26 of the flap 18. The spacer 25 has a preferred spacer thickness of one-fourth to three eighths of an inch. A cross section of the spacer 25 may vary somewhat in size, and may be square, rectangular or circular, as shown in the FIG. 1. The material may be a felt-type material, however, a commercially available polyurethane foam material is currently preferred. The material is preferably resilient, such that it may be compressed somewhat when the bib 10 is packaged, to spring back to its spacing thickness and function as contemplated herein. As a secondary quality the material of the spacer may be liquid absorbent. Opposite base surfaces 27 of the spacer 25 are preferably adhesively coated to adhere for example to the sheet 12 and the flap 18. The spacer 25 spaces the flap 18 away from the adjacent outer surface of the sheet 12 and forms a gap there between of a width substantially equal to its thickness. With the single spacer 25 attached to the center of the pocket 16, the center of the pocket is spaced away from the person, the flap 18 forming a gap of gradually decreasing width toward the lateral edges 21 and 22 of the sheet 12. As a variation of a single spacer 25, FIG. 1 shows two further spacers 28 which may be attached in a similar manner on either side of the spacer 25. The additional spacers may be desirable to space the flap or outer wall 18 of the pocket 16 uniformly over an extended portion of entire length across a width or lower edge 29 of the bib 10.

An liquid absorbent material, such as an absorbent tissue paper 31 is preferably disposed within the pocket 16. In conformance with the function of the bib 10, liquids and semi-liquid foods are not intended to remain on the major surface of the sheet 12 of the bib 10, but will run down the length of the bib 10 and into the pocket 16. To increase the holding potential of the pocket 16 for liquids, hence, to allow the liquids, once they run into the pocket to remain there, an absorbent material, such as the paper 31 is spread along the lower edge of the pocket 16. The paper 31 may be doubled up to line the pocket 16 by being folded onto itself along the lower edge 29 of the bib. Though the preferred embodiment shows an absorbent paper, cotton or other absorbent material may be used. The material may be in sheet form as the paper 31, as depicted in the sectional view of FIG. 2. In an alternate embodiment, the absorbent material may be in the form of a number of cylindrical absorbent elements or rolls 32, such as absorbent rolls used by dentists, for example, as shown in section in FIG. 5. The absorbent rolls 32 may be axially spaced with narrow gaps between adjacent rolls to allow the bib 10 to flex about a wearer's body. The rolls 32 would be disposed at the bottom of the pocket 16 at the lower edge 29 of the bib. Referring to both FIGS. 2 and 5, the absorbent material is disposed below the spacers 25 and 28. When absorbent paper 31 is used as shown in FIG. 2, it may be possible to adhere the paper on one side to the sheet 12 or to the flap 18. In such a variation of the depicted embodiment, the spacer 25, or spacers 25 and 28, as the case may be, may be adhesively attached at one of the base surfaces 27, or at both, to the inner surface of the absorbent material 31, the material 31 in turn being attached respectively to the sheet 12 or the flap 18. Such variation would be considered to be within the scope of the invention.

A further variation of the alternate embodiment depicted in FIG. 5 is illustrated in FIG. 7. It has been found that when the upper edge 26 extends only above the rolls 32 by approximately the diameter of the rolls in being folded over against the outer surface 19 of the sheet 12, the absorbent material rolls 32 themselves act as spacers of the flap 18, such that the spacer 25 or spacers 25 and 28 may be considered integrated into the absorbent material and the rolls 32 function as a combination spacer and absorbent material. In the latter described embodiment, the rolls 32 are desirably attached to the outer surface 19 of the sheet 12, or to both the outer surface and the flap. It should be realized that the variation described with respect to the latter embodiment, as shown in FIG. 7, complete spacing at the upper edge 26 of the pocket is slightly compromised for a greater convenience in packaging, as for example illustrated in FIG. 4.

The attachment of the bib 10 to a potential wearer's frontal garment should be possible without difficulty. Referring to FIG. 1, adhesive regions 34 and 35 are shown along an upper edge 36 of the sheet 12 adjacent respective upper corners 37 and 38 of the sheet 12. To protect the adhesive regions from contacting foreign matter prior to usage, a protective tab 39 is placed over each entire respective adhesive region 34 or 35. In FIG. 1, only one of the adhesive tabs 39 is shown for illustrative purposes only. Thus, the bib 10 is shown in FIG. 1, as though a user has already removed one of the protective tabs 39 and may be about to remove the other from its respective corner 37. It is particularly pointed out that the tabs 39 are larger in area than the respective adhesive regions 34 and 35. A excess length 40 of the tabs 39 extends out beyond the lateral sides 21 and 22 of the sheet 12. A potential user, consequently, may readily grasp the tab 39 at its extending length 40 and pull the protective tab 39 away from the sheet 12 to expose the respective adhesive region 34 or 25. In an actual use of the bib 10, a user might most likely remove both tabs 39 from the adhesive regions 34 and 35 and then proceed to attach the bib 10 to the garment 41, as shown in FIG. 1.

FIG. 3 shows a sectional view through the adhesive region 34, both regions 34 and 35 being preferably of the same size and materials. Various adhesives are known and commercially available. Desirably, a compound or dual adhesive layer may be used to provide an adhesive region which is intimately bonded to the sheet 12, yet bonds only weakly to the wearer's clothing. A first adhesive layer 42 is applied directly to an inner surface 43 of the sheet 12. The inner surface 43 is the surface intended to face the garment 41, hence away from the surface of the sheet at which the pocket 16 is formed. The first adhesive layer may be part of the sheet 12 itself, in that solvents are believed to be available to sensitize the sheet and form a strong bond with an outer or second adhesive layer 44 by which the bib 10 is intended to become attached to the wearer's garment 41. Prior to use, the outer adhesive layer remains preferably protected by a strip of material, such as the tab 39. The material of the tab 39 may be of a thin plastic material. However, a currently preferred material is typical waxed paper. The waxed paper appears to protect the adhesive material of the layer 44, but also appears to de-sensitize the adhesive nature such that it performs properly in attaching the bib 10 to the garment 41, but also allowing it to be readily removable. In a current embodiment, the first adhesive layer 42 was applied to the sheet 12, a separating sheet of paper 47 was applied for separation to the outer surface of the adhesive layer 42 and the second adhesive layer 44 was attached to the separating paper 47. Other adhesives, such as commercially available double-sided adhesive tapes may be used to form the adhesive regions 34 and 35.

Packaging in accordance with the application of the improved bib 10 may be in one of a number of manners. Significant is that each bib 10 of the type described herein is desirably packaged in a separate package for individual use. It is contemplated to allow business persons to carry one or more of such packages in a briefcase or coat pocket. FIG. 4 shows one type of package 48 that may be employed for the bib 10, particularly when of the type featuring absorbent rolls 32 in its pocket 16. The sheet 12 is simply rolled from the lower edge 29 with the absorbing material rolls 32 as a core 51. An outer shell 52, which may be thin paper as is used to package drinking straws, retains the layers of the sheet 12 wound about the core 51. The package 48 may then be included and served on a tray to an airline passenger, for example, together with a typical prepared lunch or dinner.

Another type of package 55 is contemplated to be a typical envelope, such as shown in phantom lines in a schematic representation of the bib 10 in FIG. 6. When such a package 55 is desired, a dual-fold parallel to the longitudinal edges 21 and 22 into three folded thicknesses as shown, and two longitudinal folds, not shown, which quarters the length of the bib 10, allows the bib to be inserted into a package or envelope 55 of a lateral size of about three by five inches. Such size is considered convenient for business persons to carry one or more of the packages 55.

It should be understood that within the scope of disclosure, changes and modifications in the structure of the described embodiment are possible without departing from the spirit and scope of the invention as described herein.

What is claimed is:

1. A bib for protecting frontal fashionable clothing worn by business persons, the bib comprising:

a substantially transparent plastic sheet of material of rectangular shape having first and second sets of edges and having respective inner and outer major surfaces, the first set of edges defining lateral edges, and the second set of edges defining respectively upper and lower edges of the bib;

a lower edge portion of the sheet folded upward as a flap, parallel to the lower edge of the sheet onto the outer major surface of the sheet, attached to the outer major surface adjacent lateral edges of the sheet, the folded flap forming a pocket at such lower edge of the bib, the pocket having an open upper edge on the outer surface of the bib; and absorbent material disposed along the length of the pocket, the absorbent means having a predetermined width for spacing the flap substantially by a distance of such width of the absorbent material from the outer surface of the sheet, such that food or liquid dripping downward along the outer surface of the sheet contacts the absorbent material within the spaced open pocket and are retained within the pocket.

2. A bib according to claim 1, wherein the absorbent material comprises a plurality of adjacent portions of cylinders axially spaced within the pocket along the lower edge of the bib.

3. A bib according to claim 1, further comprising adhesive regions disposed along the upper edge of the sheet on the inner surface thereof adjacent upper opposite corners of the bib, the adhesive regions having an exposed surface of low adhesive strength for temporarily attaching the bib to clothing of a person, and tabs disposed over the adhesive regions, the adhesive regions being protected by respective ones of the tabs disposed over exposed adhesive surfaces of the regions, the tabs being of a size larger than the respective areas of the regions and extending beyond the edges of the bib, thereby allowing the tabs to be grasped by a person and be readily removed prior to attachment of the bib by the adhesive regions to clothing of the person.

* * * * *